US009306346B2

(12) United States Patent
Vaccaro et al.

(10) Patent No.: US 9,306,346 B2
(45) Date of Patent: Apr. 5, 2016

(54) COAXIAL CABLE AND CONNECTOR WITH CAPACITIVE COUPLING

(71) Applicant: CommScope Technologies LLC, Hickory, NC (US)

(72) Inventors: Ronald A. Vaccaro, Shorewood, IL (US); David Smentek, Lockport, IL (US)

(73) Assignee: CommScope Technologies LLC, Hickory, NC (US)

( * ) Notice: Subject to any disclaimer, the term of this patent is extended or adjusted under 35 U.S.C. 154(b) by 79 days.

(21) Appl. No.: 14/305,258

(22) Filed: Jun. 16, 2014

(65) Prior Publication Data

US 2014/0370747 A1 Dec. 18, 2014

Related U.S. Application Data

(60) Provisional application No. 61/835,907, filed on Jun. 17, 2013.

(51) Int. Cl.
*H01R 9/05* (2006.01)
*H01R 24/42* (2011.01)

(52) U.S. Cl.
CPC ..... *H01R 24/42* (2013.01)

(58) Field of Classification Search
CPC ..... H01R 24/38; H01R 24/42; H01R 24/44; H01R 2103/00; H01R 9/0521
USPC ..... 439/578
See application file for complete search history.

(56) References Cited

U.S. PATENT DOCUMENTS

| | | | |
|---|---|---|---|
| 7,785,144 | B1 | 8/2010 | Islam |
| 8,479,383 | B2 | 7/2013 | Van Swearing et al. |
| 2005/0181668 | A1 | 8/2005 | Montena et al. |
| 2007/0093127 | A1 | 4/2007 | Thomas et al. |
| 2010/0087090 | A1 | 4/2010 | Islam |
| 2011/2021230 | | 8/2011 | Islam |
| 2013/0065415 | A1 | 3/2013 | Van Swearing et al. |
| 2013/0065420 | A1 | 3/2013 | Van Swearing et al. |

OTHER PUBLICATIONS

International Search Report and Written Opinion for corresponding PCT application No. PCT/US2014/042474, date of mailing Oct. 10, 2014.

*Primary Examiner* — Khiem Nguyen
(74) *Attorney, Agent, or Firm* — Myers Bigel & Sibley, P.A.

(57) ABSTRACT

A coaxial cable-connector assembly includes a coaxial cable and a coaxial cable connector. The coaxial cable includes: a central conductor having a connector end; a dielectric layer that overlies the central conductor; and an outer conductor that overlies the dielectric layer having a connector end. The coaxial connector includes: a central conductor extension configured to mate with a mating connector at one end; a first insulative layer interposed between an opposed second end of the central conductor extension and the connector end of the central conductor; an outer conductor extension configured to mate with a mating connector at one end; and a second insulative layer interposed between an opposed second end of the outer conductor extension and the connector end of the outer conductor. This configuration can reduce and/or avoid PIM within the connection of two coaxial connectors.

21 Claims, 2 Drawing Sheets

COAXIAL CABLE AND CONNECTOR WITH CAPACITIVE COUPLING

RELATED APPLICATION

The present invention claims the benefit of and priority from U.S. Provisional Patent Application No. 61/835,907, filed Jun. 17, 2013, the disclosure of which is hereby incorporated herein by reference in its entirety.

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between a cable terminated with a connector bearing the desired connector interface and a corresponding connector with a mating connector interface mounted on an apparatus or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

Passive Intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire RF system. Thus, the reduction of PIM via connector design is typically desirable.

SUMMARY OF THE INVENTION

As a first aspect, embodiments of the invention are directed to a coaxial cable-connector assembly. The assembly comprises a coaxial cable and a coaxial cable connector. The coaxial cable comprises: a central conductor having a connector end; a dielectric layer that overlies the central conductor; and an outer conductor that overlies the dielectric layer having a connector end. The coaxial connector comprises: a central conductor extension configured to mate with a mating connector at one end; a first insulative layer interposed between an opposed second end of the central conductor extension and the connector end of the central conductor; an outer conductor extension configured to mate with a mating connector at one end; and a second insulative layer interposed between an opposed second end of the outer conductor extension and the connector end of the outer conductor. This configuration can reduce and/or avoid PIM within the connection of two coaxial connectors.

As a second aspect, embodiments of the invention are directed to a coaxial cable-connector assembly comprising a coaxial cable and a coaxial cable connector. The coaxial cable comprises: a central conductor having a connector end; a dielectric layer that overlies the central conductor; and an outer conductor that overlies the dielectric layer having a connector end. The coaxial connector comprises: a central conductor extension configured to mate with a mating connector at one end; a first insulative layer interposed between an opposed second end of the central conductor extension and the connector end of the central conductor; an outer conductor extension configured to mate with a mating connector at one end; and a second insulative layer interposed between an opposed second end of the outer conductor extension and the connector end of the outer conductor. A portion of the outer conductor extension directly contacts the outer conductor to form a ground connection. This configuration can enable the assembly to be "tuned" to operate optimally at certain frequencies.

As a third aspect, embodiments of the invention are directed to a coaxial cable-connector assembly, comprising a coaxial cable and a coaxial cable connector. The coaxial cable comprises: a central conductor having a connector end; a dielectric layer that overlies the central conductor; and an outer conductor that overlies the dielectric layer having a connector end. The coaxial connector comprises: a central conductor extension configured to mate with a mating connector at one end; an outer conductor extension configured to mate with a mating connector at one end; and an insulative layer interposed between an opposed second end of the outer conductor extension and the connector end of the outer conductor. The insulative layer circumferentially overlies the outer conductor, and the outer conductor extension at least partially overlies the insulative layer.

As a fourth aspect, embodiments of the invention are directed to a coaxial cable-connector assembly, comprising a coaxial cable and a coaxial connector. The coaxial cable comprises: a central conductor having a connector end; a dielectric layer that overlies the central conductor; and an outer conductor that overlies the dielectric layer having a connector end. The coaxial connector comprises: a central conductor extension configured to mate with a mating connector at one end; an outer conductor extension configured to mate with a mating connector at one end; and an insulative layer interposed between an opposed second end of the inner conductor extension and the connector end of the inner conductor.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments1

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
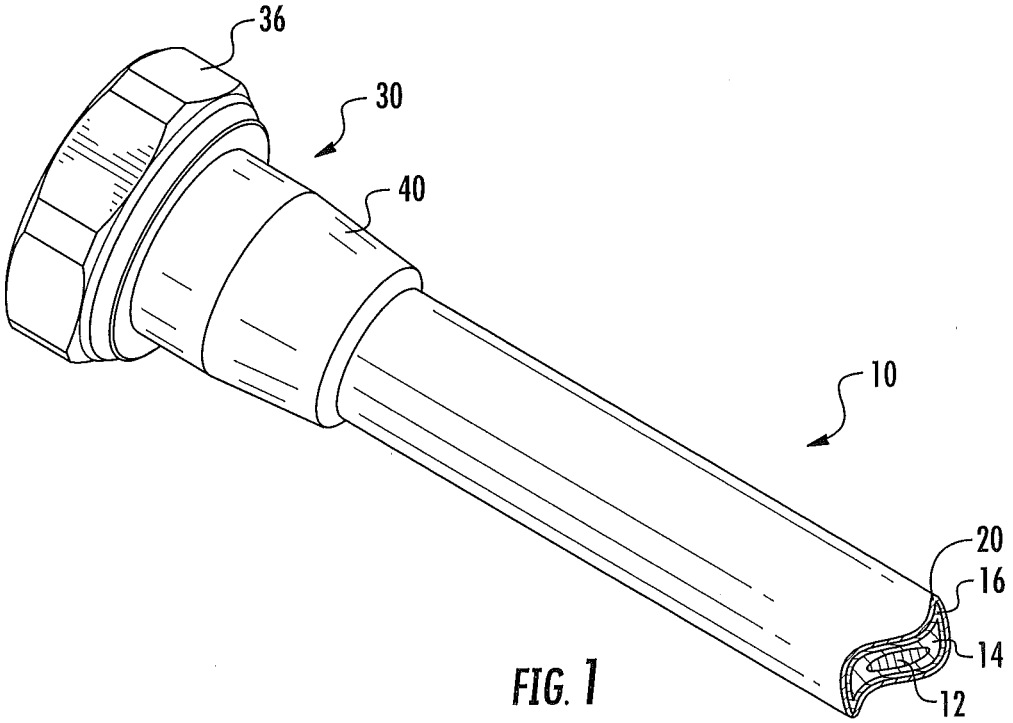
FIG. 1 is a perspective view of a coaxial cable-connector assembly according to embodiments of the invention.
Figure 2:
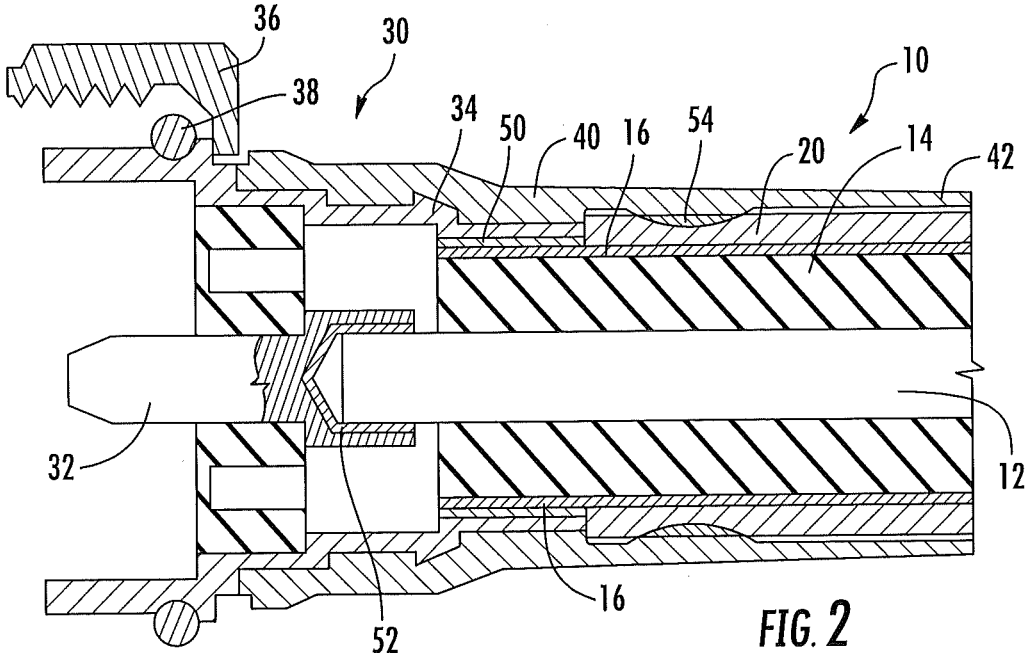
FIG. 2 is a partial cross-section of the coaxial cable-connector assembly of FIG. 1.
Figure 3:
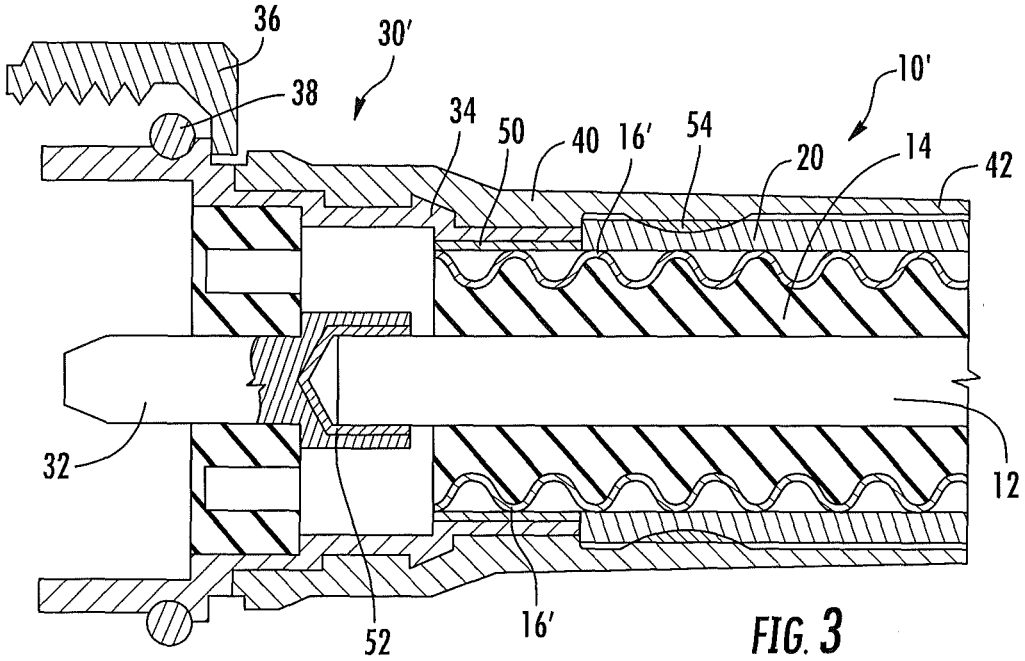
FIG. 3 is a partial cross-section of a coaxial cable-connector assembly according to additional embodiments of the present invention.

FIGS. 1 and 2 illustrate a coaxial cable, designated broadly at 10, according to embodiments of the present invention. The cable 10 includes a central conductor 12, a dielectric layer 14 that circumferentially overlies the central conductor 12, an outer conductor 16 that circumferentially overlies the dielectric layer 14, and a polymeric cable jacket 20 that circumferentially overlies the outer conductor 16. These components will be well-known to those of skill in this art and need not be described in detail herein. FIG. 2 illustrates schematically that the outer conductor 16 may be of a smooth profile; alternatively, as shown in FIG. 3, the outer conductor 16' of a cable 10' may have a corrugated profile. Both of these outer conductor configurations are known to those of skill in this art and need not be described in detail herein.

Referring again to FIGS. 1 and 2, the cable 10 includes a plug 30 that enables the cable 10 to be connected with a jack of a mating coaxial. The plug 30 includes a central conductor extension 32, an outer conductor extension 34, a coupling nut 36, an O-ring 38, and an overmold body 40. The central conductor extension 32 and the outer conductor extension 34 are configured to mate at their free ends (i.e., the ends on the left side of FIG. 2) with the respective conductors of a mating coaxial cable jack (not shown). One exemplary configuration for the central and outer conductor extensions 32, 34 is a 7/16 DIN connection, although other configurations, such as Type N and 4.1/9.5 DIN, may also be employed.

As can be seen in FIG. 2, rather than contacting the outer conductor 16 directly, the outer conductor extension 34 contacts an insulative layer 50 that overlies the outer surface of the outer conductor 16. The insulative layer 50, which may be a coating or a separate overlying layer, has sufficient dielectric properties to establish a capacitive element between the outer conductor 16 and the outer conductor extension 34. The capacitive element so created can avoid or reduce PIM (described above) that can occur in interconnecting coaxial cables.

Similarly, an insulative layer 52 is interposed between the end of the central conductor 12 and the central conductor extension 32. The insulative layer 52 has sufficient dielectric properties to establish a capacitive element between the central conductor 12 and the central conductor extension 32.

Exemplary materials for the insulative layers 50, 52 include ceramics, polymeric materials, and glass. The dielectric strength and/or constant of the materials of the insulative layers 50, 52, which may be between about 0.005 and 0.060 inches in thickness, is typically between about 2 and 15. They may be applied in a number of different ways, including painting, spraying, sputter coating, or the like. In some embodiments, the capacitive element is sized and arranged so that it creates capacitance on the order of 10-50 picofarads between the conductors 12, 16 of the cable 10 and their respective extensions 32, 34.

Referring again to FIGS. 1 and 2, the overmold body 40 overlies much of the outer conductor extension 34. The overmold body 40 is typically fashioned over the outer conductor extension 34, such that these two components form a single integral piece, and includes a hollow "tail" 42 that fits over the cable jacket 20. In some embodiments, the overmold body 40 is formed of a polymeric material; if so, the overmold body 40 may be fixed to the cable jacket 20 via spin welding (the interface between the overmold body 40 and the cable jacket 20 is shown in FIG. 2 at 54), which can provide a quick and easy attachment technique.

Referring still to FIGS. 1 and 2, the coupling nut 36 can be of conventional construction. In some instances, the coupling nut 36 may be formed of a metal material, such as brass; in other instances, the coupling nut 36 may be formed of a polymeric material. The O-ring 38 is present to provide a watertight seal to the connection of the conductors and may be located in different positions between the coupling nut 36 and a mating threaded component, depending on the material of the coupling nut 36.

The plug 30 would be connected to a mating jack (not shown) that provides electrical contacts for the central and outer conductor extensions 32, 34, In this configuration, the cable 10 and plug 30 can be attached to a standard mating coaxial cable jack that requires no modification, while still enjoying the potentially PIM-reducing benefit of capacitive coupling of the central and outer conductors 12, 16 and their respective conductor extensions 32, 34 due to the presence of the insulative layers 50, 52.

Figure 4:
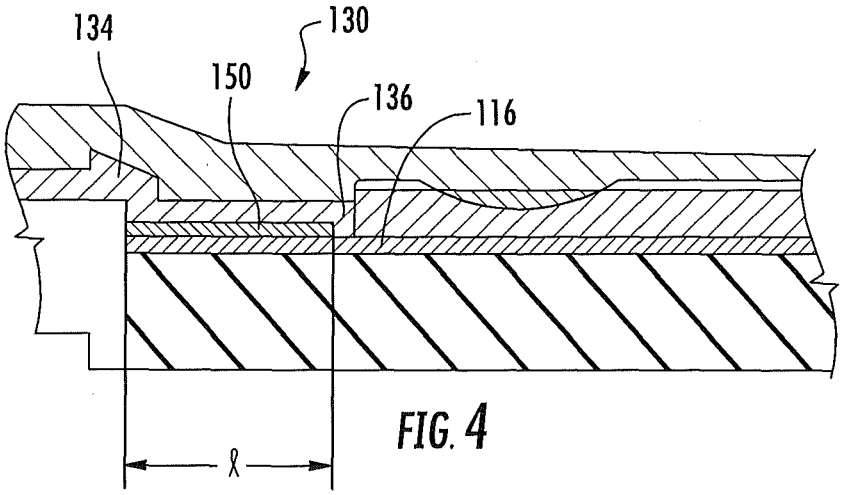
FIG. 4 is a partial cross-section of another alternative embodiment of a coaxial cable-connector assembly according to embodiments of the present invention.

Referring now to FIG. 4, another embodiment of a coaxial cable plug, designated broadly at 130, is shown therein. The plug 130 includes the components discussed above with respect to the plug 30; however, the outer conductor extension 134 includes a flange 136 that directly contacts a portion of the outer conductor 116. Thus, the outer conductor extension 134 contacts the outer conductor 116 as well as being separated from an additional portion of the outer conductor 116 by an insulative coating 150. This direct contact with the outer conductor 116 provides a direct grounding path for the outer conductor 116. The length "l" and location of the insulative layer 150 can be varied to ground different frequencies (and, in turn, reduce noise), which can provide the designer with the opportunity to "tune" the plug 130 to operate optimally at particular frequencies. The frequency response may also be affected, with improvements in usable bandwidth, return loss and insertion loss potentially being realized.

The materials, thickness, etc. for the insulative layer 150 can be the same as discussed above with respect to the insulative layers 50, 52.

Although the plugs 30, 130 are illustrated herein attached to a free or loose coaxial cable 10, in some embodiments one of these connectors may be mounted within a structure, such as a shoulder plate such as that described in co-pending and co-assigned U.S. Patent Publication No. 2013/0065415, the disclosure of which is hereby incorporated herein by reference, that presents multiple connectors at once. Such a shoulder plate or similar mounting structure may be mounted on an antenna, amplifier or the like. It will also be understood that the insulative layers 50, 52 may be applicable to a coaxial jack or other connector as well as a coaxial plug.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable-connector assembly, comprising:
(a) a coaxial cable comprising:
a central conductor having a connector end;
a dielectric layer that overlies the central conductor; and
an outer conductor that overlies the dielectric layer having a connector end; and
(b) a coaxial connector, comprising:
a central conductor extension configured to mate with a mating connector at one end;
a first insulative layer interposed between an opposed second end of the central conductor extension and the connector end of the central conductor;
an outer conductor extension configured to mate with a mating connector at one end; and
a second insulative layer interposed between an opposed second end of the outer conductor extension and the connector end of the outer conductor.

2. The coaxial cable-connector assembly defined in claim 1, further comprising an overmold body that at least partially overlies the outer conductor extension.

3. The coaxial cable-connector assembly defined in claim 2, wherein the overmold body is formed of a polymeric material, and wherein the overmold body is fixed to the cable jacket via spin welding.

4. The coaxial cable-connector assembly defined in claim 2, wherein the overmold body and the outer conductor extension are formed as an integral unit.

5. The coaxial cable-connector assembly defined in claim 1, wherein the first insulative layer forms a capacitive element between the central conductor and the central conductor extension.

6. The coaxial cable-connector assembly defined in claim 1, wherein the second insulative layer forms a capacitive element between the outer conductor and the outer conductor extension.

7. The coaxial cable-connector assembly defined in claim 1, wherein the second insulative layer circumferentially overlies the outer conductor, and wherein the outer conductor extension at least partially overlies the second insulative layer.

8. The coaxial cable-connector assembly defined in claim 5, wherein the first insulative layer is selected to reduce PIM.

9. The coaxial cable-connector assembly defined in claim 6, wherein the second insulative layer is selected to reduce PIM.

10. The coaxial cable-connector assembly defined in claim 1, wherein at least one of the first and second insulative layers comprises a dielectric coating.

11. A coaxial cable-connector assembly, comprising:
(a) a coaxial cable comprising:
a central conductor having a connector end;
a dielectric layer that overlies the central conductor; and
an outer conductor that overlies the dielectric layer having a connector end; and
(b) a coaxial connector, comprising:
a central conductor extension configured to mate with a mating connector at one end;
a first insulative layer interposed between an opposed second end of the central conductor extension and the connector end of the central conductor;
an outer conductor extension configured to mate with a mating connector at one end; and
a second insulative layer interposed between an opposed second end of the outer conductor extension and the connector end of the outer conductor;
wherein a portion of the outer conductor extension directly contacts the outer conductor to form a ground connection.

12. The coaxial cable-connector assembly defined in claim 11, further comprising an overmold body that at least partially overlies the outer conductor extension.

13. The coaxial cable-connector assembly defined in claim 12, wherein the overmold body and the outer conductor extension are formed as an integral unit.

14. The coaxial cable-connector assembly defined in claim 11, wherein the first insulative layer forms a capacitive element between the central conductor and the central conductor extension.

15. The coaxial cable-connector assembly defined in claim 11, wherein the second insulative layer forms a capacitive element between the outer conductor and the outer conductor extension.

16. The coaxial cable-connector assembly defined in claim 11, wherein the second insulative layer circumferentially overlies the outer conductor, and wherein the outer conductor extension at least partially overlies the second insulative layer.

17. The coaxial cable-connector assembly defined in claim 16, wherein the first insulative layer is selected to reduce PIM.

18. The coaxial cable-connector assembly defined in claim 17, wherein the second insulative layer is selected to reduce PIM.

19. The coaxial cable-connector assembly defined in claim 11, wherein at least one of the first and second insulative layers comprises a dielectric coating.

20. A coaxial cable-connector assembly, comprising:
(a) a coaxial cable comprising:
a central conductor having a connector end;
a dielectric layer that overlies the central conductor; and
an outer conductor that overlies the dielectric layer having a connector end; and
(b) a coaxial connector, comprising:
a central conductor extension configured to mate with a mating connector at one end;
an outer conductor extension configured to mate with a mating connector at one end; and
an insulative layer interposed between an opposed second end of the outer conductor extension and the connector end of the outer conductor, wherein the insulative layer circumferentially overlies the outer conductor, and wherein the outer conductor extension at least partially overlies the insulative layer.

21. A coaxial cable-connector assembly, comprising:
(a) a coaxial cable comprising:
a central conductor having a connector end;
a dielectric layer that overlies the central conductor; and
an outer conductor that overlies the dielectric layer having a connector end; and (b) a coaxial connector, comprising:

a central conductor extension configured to mate with a mating connector at one end;

an outer conductor extension configured to mate with a mating connector at one end; and an insulative layer interposed between an opposed second end of the central conductor extension and the connector end of the central conductor.

* * * * *